US006764251B1

(12) United States Patent
Schnur

(10) Patent No.: US 6,764,251 B1
(45) Date of Patent: Jul. 20, 2004

(54) ANCHOR

(76) Inventor: Anthony J. Schnur, 212 Cannon Rd., Wilmington, NC (US) 28411

( * ) Notice: Subject to any disclaimer, the term of this patent is extended or adjusted under 35 U.S.C. 154(b) by 25 days.

(21) Appl. No.: 10/188,850

(22) Filed: Jul. 5, 2002

Related U.S. Application Data

(60) Provisional application No. 60/302,680, filed on Jul. 5, 2001.

(51) Int. Cl.[7] ..... E02D 5/80; E02D 27/50

(52) U.S. Cl. ..... 405/224; 52/162; 405/244

(58) Field of Search ..... 405/244, 259.3, 405/259.4, 226, 203, 224; 114/304; 52/159, 162, 163, 164

(56) References Cited

U.S. PATENT DOCUMENTS 798,654 A * 9/1905 Bliler ..... 52/162
2,881,591 A * 4/1959 Reeve ..... 405/224
3,012,644 A * 12/1961 Bush ..... 52/162
3,526,069 A * 9/1970 Deike ..... 405/244
3,763,655 A 10/1973 Galuska
3,935,912 A 2/1976 Shibata
4,023,314 A * 5/1977 Tanner ..... 52/162
4,576,521 A 3/1986 Conrad
5,553,978 A 9/1996 Bates
5,881,506 A * 3/1999 Chapman et al. ..... 52/163

* cited by examiner

*Primary Examiner*—Michael Safavi
(74) *Attorney, Agent, or Firm*—Patent & Trademark Services, Inc; Thomas Zack; Joseph H. McGlynn

(57) ABSTRACT

An anchor formed of a hollow tube and pivotally attached wings with fluid pressure in the tube being used to expand the wings outwardly. A ring encircles the hollow tube and is attached to the outside surface of the hollow tube to allow for securement of cables to the anchor.

7 Claims, 2 Drawing Sheets

ANCHOR

Applicant claims priority of Provisional Ser. No. 60/302,680, filed Jul. 5, 2001.

BACKGROUND OF THE INVENTION

This invention relates to an anchor and a method for installing the anchor where the anchor has a pair of pivoted wings.

Anchors have long being used to keep objects in place on the land and under water. On land, anchors have been used in conjunction with mobile homes, temporary construction offices and trailers, large tents, airplanes, free standing buildings, guy wires and retaining wall tiebacks. In water, anchors have been used to anchor boats, beach access, piers, pilings, and mooring buoys.

When hurricanes and other fierce weather conditions occur, it is essential that the anchor be kept in place to prevent undesired consequences to attached structures. To do so, the anchor must have a strong gripping surface to contact the ground, or earth, around where the anchor is seated to provide maximum resistance to movement.

In providing for this gripping surface, earlier inventions have used one or more wings or side flanges that extend outwardly from a main shaft to which they are attached. The present invention is directed to an improvement over such inventions which can be used both on land or in the water to firmly anchor an object.

DESCRIPTION OF THE PRIOR ART

Anchors and anchoring methods having extending wings or flanges from a central or main shaft are known in the prior art. For example, U.S. Pat. No. 3,763,655 to Galuska discloses an anchor with a frangible casing through which flanges protrude when the anchor is in place.

U.S. Pat. No. 3,935,912 to Shibata discloses an anchor having a plurality of pivoting flanges which are spring biased.

U.S. Pat. No. 4,576,521 to Conrad discloses an anchor which is placed in the sea bed by means of fluid forced through a hollow tube.

U.S. Pat. No. 5,553,978 to Bates discloses an expandable anchor for attachment to pilings.

In the present invention a method of installing an anchor and the anchor is disclosed in which there is a hollow tube having a pair of pivotally attached wings with the tube and wings being forced into the ground by fluid pressure through the tube, all as will be detailed in the specification that follows hereafter.

SUMMARY OF THE INVENTION

This invention relates to an anchor and a method for placing the anchor in the ground which uses a hollow tube and pivotally attached wings with fluid pressure in the tube used to expand the wings outwardly.

It is the primary object of the present invention to provide for an improved anchor and anchoring method to install the anchor in place.

Another object is to provide for such an anchor and the method of installing the anchor wherein a hollow tube has pivotally attached wings that are forced by fluid pressure in the tube to expand outwardly before removing a pressure supplying conduit.

These and other objects and advantages of the present invention will become apparent to readers from a consideration of the ensuing description and the accompanying drawings.

DESCRIPTION OF THE PREFERRED EMBODIMENT

Figure 1:
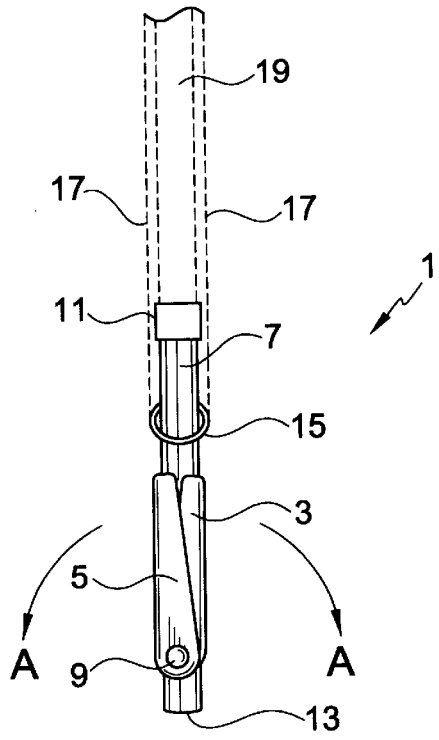
FIG. 1 is a side view of the anchor used in the present invention with the wings in a collapsed position.

FIG. 1 is a side view of the anchor 1 of the present invention with the side flanges, or wings 3 and 5 in a collapsed position. Both wings 3, 5 are pivotally attached to the hollow tube 7. The wings 3, 5 are shaped and sized substantially identically. A bolt 9, whose end is shown, extends through a hole in an end of each wing 3, 5. A conventional fastener fixes the bolt 9 in place. By off set mounting the wings from each other, they may fold over each other as depicted. The upper end of tube 7 has a larger diameter collar 11 having internal threads. The lower end 13 of tube 7 is open. Encircling the tube 7, above the wings 3, 5, is a thimble eye 15. Thimble eye 15 is welded to tube 7. The thimble eye 15 provides a means for attaching a cable 17, shown in dotted line format, to the anchor tube 7. The cable 17 can be used to lower/raise the tube 7. An upper tube extension 19, also shown in dotted line format, may be threaded into collar 11 to introduce pressurized fluid, like water, into the tube 7.

As shown by the direction of the arrows A, free ends of the wings 3, 5 may be extended outwardly from their connections to the tube 7. This is accomplished by introducing pressurized fluid such as, but not limited to, water into the tube 7, which fluid exits through holes 23 in the sides (see FIG. 2) of the tube to move the wings from a collapsed position, as shown in FIG. 1, to an extended position, as shown in FIG. 2.

Figure 2:
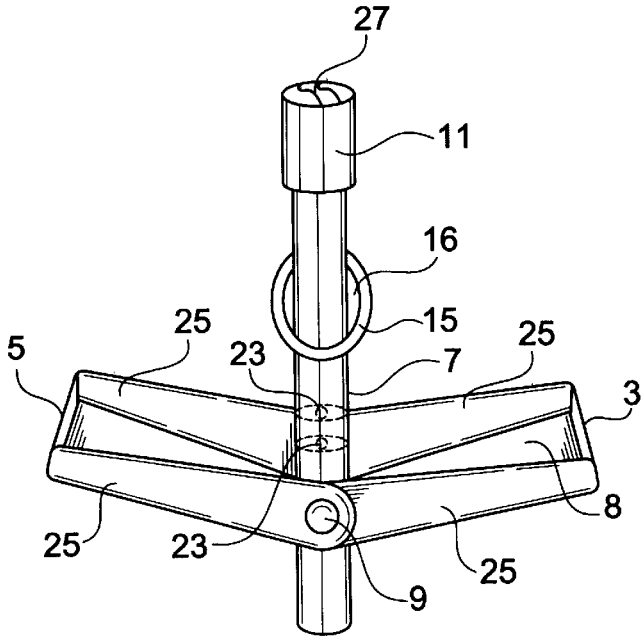
FIG. 2 is a perspective view of the FIG. 1 anchor with the wings in an expanded position.

FIG. 2 is a perspective view of the FIG. 1 anchor 1 with the wings 3, 5 in an extended position. Each wing 3, 5 extends to a side of the tube 7. The connecting bolt 9 extends through the ends of wings 3, 5 and into and through the tube 7, and forms a pivot point for the wings 3, 5. A conventional nut (not shown) retains the bolt 9 in place. Spaced along the tube 7 are through holes 23. The number of holes 23 are not critical, as long as there are enough holes to direct fluid pressure from the tube 7 to the wings 3, 5, and to pivot the wings to their extended position. The holes 23 allow pressurized fluid to pass through hollow tube 7 and to engage the facing surfaces 8 of the wings 3, 5. The pressurized fluid forces the wings to pivot downwardly, as shown in FIG. 2, to an unfolded or expanded position. Each wing 3, 5 has two raised sides 25 on each side of the tube 7. A lower recessed surface 8 extends between the sides 25 on each wing 3, 5. It should be noted that any conventional source of pressurized fluid can be used with the present invention.

As stated previously, by making the wings 3, 5 slightly offset from each other, the collapsed wings can overlap each other when folded together as shown in FIG. 1.

The thimble eye, or ring, 15 has a center hole 16 which allows the cable 17, shown in dotted line format in FIG. 1, to be inserted through hole 16, and then around the ring 15 and attached in any conventional manner. The internal diameter of ring 15 is smaller than the external diameter of fitting 11 to prevent the ring 15 from slipping up the tube 9. The fitting 11 has threads 27 which mate with external threads on tube extension 19, shown in FIG. 3, to extend the length of tube 9.

As shown in FIG. 2, the wing 3 fits to one side of the wing 5 with the bolt 9 extending through the two sides of each wing. In FIG. 2, both the cable 17 and tube extension 19 are not shown for clarity.

Figure 3:
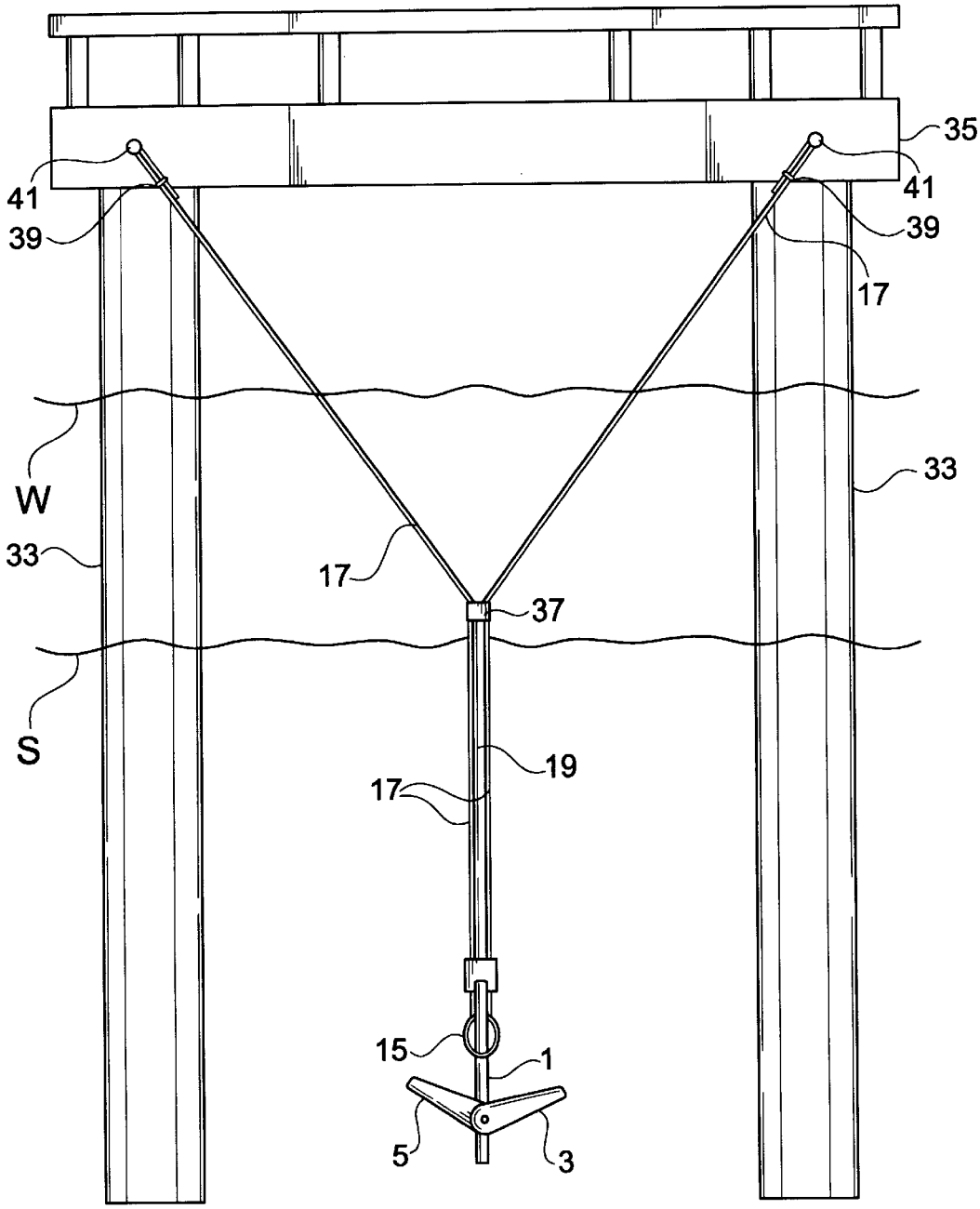
FIG. 3 is a schematic diagram of the anchor inserted into the ground below the supporting pilings of a pier.

FIG. 3 is a schematic diagram of anchor 1 after it has been inserted into the sand S below the supporting pilings 33 of pier 35. The supporting cables 17 extend from the ring 15 to a common swagging sleeve 37. From sleeve 37 the cables 17 branches out in two directions to the cable clamps 39, which secure the cables to fasteners 41 inserted into the pier 35. This arrangement secures the cables 17 of anchor 1 to the pier 35.

W indicates the water level above the sand and below the pier.

In installing the anchor 1, as shown in the FIG. 3, extension conduit 19 is first threaded into the anchor collar 11. The anchor 1 is then forced into the sand S below the water level W. The folded or collapsed wings 3, 5 are then opened. Expanding the wings is accomplished by injecting pressurized fluid pumped into tube 7 from a pump (not shown) through the tube extension 19.

The pressurized water exits from tube holes 23 (see FIG. 2) to expand the wings outwardly into the adjacent sand. At the same time, the pressurized water also exists from opened tube end 13 blowing away the adjacent sand to provide for a seat for tube 7. The end of tube 7, below the wings, fits into this seat to provide a firm anchorage. Along with the now unfolded wings 3, 5, the anchored tube 7 forms a firm hold for the anchor in the sand. Once the adjacent sand settles, the anchor 1 is firmly fixed in position by the sand. Next, the fluid pressure is removed and extension 19 can be removed from upper end of tube 7. Once this occurs, the only anchor attachment to the surface is cables 17 fixed to ring 15. The cables 17, in turn, are fixed to the pier.

If the anchor 1 were to be used on land, a post hole digger could be used beforehand to form the ground hole for the tube 7. Using high fluid pressures, folded wings 3, 5 could be expanded outwardly into the adjacent ground. Back filling material (dirt, concrete, etc.) could then be placed around the post on all sides filling in any visible holes to insure a firm anchor hold.

The anchor 1 can be manufactured in different sizes to suit the needs of the particular user. The materials used to construct the various components would depend on the particular use of the anchor. Thus, for use below water, waterproof or highly water resistant materials would be used. Using more than one cable 17 fixed to the anchor 1 insures a greater holding power especially when the cables are attached together to double or even triple the tensional strength over an individual cable.

Although the Anchor and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An anchor comprising:

a hollow tube, said hollow tube having an upper end and a lower end, means for securing cables to said upper end, means for securing said hollow tube into a surface secured to said lower end, said means for securing said hollow tube into a surface comprising a pair of wings, said wings being connected to said lower end, and said wings are moveable from a first position where they are positioned closely adjacent to said hollow tube, to a second position where they are positioned remotely from said hollow tube, and wherein said hollow tube has a fitting secured to said upper end, and said means for securing cables to said upper end is a ring, said ring being positioned between said fitting and said lower end, and wherein said ring encircles said hollow tube, and said ring is permanently attached to an outside surface of said hollow tube.

2. The anchor as claimed in claim 1, wherein each of said pair of wings has a facing surface and a pair of side surfaces extending from said facing surface, and the pair of side surfaces on one of said pair of wings are offset from the pair of side surfaces on another of said pair of wings, and means extending through said side surfaces for securing said wings to said hollow tube.

3. The anchor as claimed in claim 1, wherein said means for moving said wings from said first position to said second position is pressurized fluid.

4. The anchor as claimed in claim 1, wherein said fitting has means for attaching extensions to said fitting.

5. The anchor as claimed in claim 4, wherein said means for attaching extensions to said fitting are screw threads.

6. The anchor as claimed in claim 1, wherein said hollow tube has apertures adjacent said wings, whereby fluid forced through said hollow tube can pass through said apertures and engage said wings.

7. The anchor as claimed in claim 1 in combination with a pier, wherein cables are attached at one end to said pier and said cables are attached at another end to said means for securing cables to said upper end.

* * * * *